United States Patent [19]

Johnson

[11] 4,147,034

[45] Apr. 3, 1979

[54] HYDRAULIC SYSTEM WITH PRIORITY CONTROL

[75] Inventor: Howard L. Johnson, Joliet, Ill.

[73] Assignee: Caterpillar Tractor Co., Peoria, Ill.

[21] Appl. No.: 897,893

[22] Filed: Apr. 19, 1978

[51] Int. Cl.[2] ..... F15B 11/16; F15B 13/09

[52] U.S. Cl. ..... 60/422; 60/486; 180/66 R

[58] Field of Search ..... 60/420, 421, 422, 486; 91/461; 180/66 R

[56] References Cited

U.S. PATENT DOCUMENTS

| | | | |
|---|---|---|---|
| 3,987,622 | 10/1976 | Johnson | 60/420 |
| 3,987,704 | 10/1976 | Johnson | 60/421 |
| 3,998,053 | 12/1976 | Johnson | 60/422 |
| 4,089,346 | 5/1978 | Budzich | 60/445 |

*Primary Examiner*—Edgar W. Goeghegan

*Attorney, Agent, or Firm*—Wegner, Stellman, McCord, Wiles & Wood

[57] ABSTRACT

A hydraulic system including a pressure and flow compensated pump, a source of pilot fluid under pressure, a plurality of hydraulic circuits each including a work performing device, a plurality of controls, one for each circuit, each including a pilot operated flow valve for connecting the associated work performing device to the pump and an operator positioned valve connected to the pilot source for selectively directing pilot fluid to the corresponding flow valve, the work performing devices and the flow valves being connected in parallel. The system further includes a supply margin valve having pressure responsive surfaces respectively connected to the pump and to the work performing devices for providing a control signal to the pump to cause the same to supply fluid at a pressure equal to the pressure required by the work performing devices plus a predetermined margin and a first demand margin valve having pressure responsive surfaces respectively connected to the pump and to the work performing devices for decreasing the pressure of pilot fluid directed to some, but not all, of the operator positioned valves when the predetermined margin is not met. There is further included a second demand margin valve having pressure responsive surfaces respectively connected to the pump and to the work performing devices for decreasing the pressure of the pilot fluid directed to at least one of the others of the operator positioned valves when the predetermined margin is not met by more than a predetermined amount so that the first demand margin valve will decrease pilot pressure to certain of the valves before the second demand margin valve decreases pilot pressure to the other of the valves.

9 Claims, 2 Drawing Figures

PILOT
14
60
10
SUPPLY MARGIN CIRCUIT
DEMAND MARGIN CIRCUIT
36
STICK CIRCUIT
34
STICK CONTROL
SWING CONTROL
SWING CIRCUIT
38
40
172
170
158
154
156
174
160
152
180
186
182
176
190
184
188
192
194
178
136
130
138
54
134
140
120
122
124
126
128
58
56
52
132
200
74L
204
74R
202
74T
24
26
RIGHT TRACK CIRCUIT
46
50
22
28
48
LEFT TRACK CIRCUIT 60
12
66
62
72
82
88
80
86
77
70
68
64
74
100
90
94
84
96
74
150
18
76
20
BOOM CIRCUIT
22
24
26
16
21
28
BOOM CONTROL
BUCKET CONTROL
74
30
BUCKET CIRCUIT
32
106
104
42
102
RIGHT
TRACK
LEFT
CONTROL
74T
44
108

HYDRAULIC SYSTEM WITH PRIORITY CONTROL

BACKGROUND OF THE INVENTION

This invention relates to hydraulic systems of the type including one or more flow and pressure compensated pumps for providing hydraulic fluid under pressure to parallel hydraulic circuits, each including a work performing means.

Increasingly, hydraulic systems having work performing devices subjected to variable loading are utilizing one or more flow and pressure compensated pumps for the reason that such pumps maximize system efficiency within their capacity and yet provide a considerable reduction in energy requirements. In the operation of many such systems, only infrequently are the various work performing devices simultaneously subjected to maximum load conditions with the result that it is uneconomical to provide pump capacity that is sufficiently high that the fluid requrements of all work performing devices can be fully met when all are simultaneously being subjected to maximum load conditions. As a consequence, most systems of this type are provided with a pump capacity that is less than the theoretical maximum required for the specific situation wherein all components are subject to maximum load.

Nonetheless, during the operation of such systems, this infrequently occurring happening will take place periodically. And, where one of the work performing devices provides a relatively low resistance to the passage of hydraulic fluid as opposed to one or more of the other work performing devices, the demand for fluid by the low resistance work performing device will be substantially fully satisfied with the consequence that flow to the higher resistance work performing devices will be severely cut back thereby severely diminishing the ability of the high resistance work performing device to perform its intended function during the occurrence.

All too frequently, the nature of the system will be such that, in the usual operation, the function produced by the low resistance work performing device is one of lesser importance to the operation being performed by the system while the function being performed by the high resistance work performing device is of considerably greater consequence and importance.

As a result, quite undesirably, a most desirable function cannot be satisfactorily performed while a function of less importance can be.

In order to solve the difficulty, the prior art has suggested the provision of priority devices whereby the demand of the work performing devices performing the more important functions is first satisfied, and only after such satisfaction has been attained, is the demand of the work performing devices performing functions of lesser importance attended to. Typically, the priority determination is accomplished by means contained within flow control valves which directly interconnect the pump or pumps and the work performing means. As a consequence, the priority determining means are necessarily large since they are interposed in hydraulic circuits having large flow rates and must be designed to withstand the high pressures typically associated with many hydraulic systems.

In addition, many such hydraulic systems employ plural pumps, each for normally providing fluid under pressure to an associated group of work performing devices. In order to maximize efficiency, means have been provided whereby the output of one pump may be transmitted to work performing devices not normally associated therewith so as to maximize the use of the total pumping capacity employed in the system.

Heretofore, such transfer means have utilized spool valves which tend to be rather expensive and which tend to be relatively leaky as compared to other types of known valves.

SUMMARY OF THE INVENTION

The present invention is directed to overcoming one or more of the above problems.

According to one aspect of the invention, there is provided a hydraulic system including a pressure and flow compensated pump. There is also provided a source of pilot fluid under pressure and a plurality of hydraulic circuits, each including a work performing means. A plurality of controls are provided, one for each circuit, each including a pilot operated flow valve for connecting the associated work performing means to the pump and an operator positioned valve connected to the pilot source for selectively directing pilot fluid to the corresponding flow valve. Each work performing means in the corresponding flow valve is connected in parallel with respect to the other flow valves and work performing means and there is provided means connected to the work performing means and the pump for controlling the pump supply fluid at a pressure in excess, by a predetermined margin, of that required by any of the work performing means. There is further provided a priority determining means connected to the pilot source and to at least one, but not all, of the operator positioned valves for changing a pressure characteristic of the pilot pressure to the operator positioned valve to which it is connected whenever the pressure of the supply fluid from the pump does not exceed the pressure required by any of the work performing means by the predetermined margin to cause the flow valve associated with the operator positioned valve to decrease flow to an associated work performing means whereby priority of supply of fluid flow to the work performing means not associated with the priority determining means is assured.

According to another aspect of the invention, there is provided a hydraulic system including a plurality of pressure and flow compensated pumps along with a plurality of controllable work performing means, each normally connectable by control valves to a particular one of the pumps. Means are provided for connecting each of the work performing means to at least one of the pumps in addition to or other than the particular pump and include a plurality of pilot operated poppet valves, each having a first port connected to an associated one of the pumps. The poppet valves have interconnected second ports and bleed valve means responsive to pressure differentials between the pumps are provided. An orifice means interconnects the pilots of the poppet valves and the second ports and the bleed valve means.

Preferably, though not necessarily, both aspects of the invention as defined above are employed in a system.

Other objects and advantages will become apparent from the following specification taken in connection with the accompanying drawings.

DESCRIPTION OF THE DRAWINGS

The FIGURE is comprised of FIGS. 1A and 1B and is a schematic of a hydraulic system made according to the invention, FIG. 1B being adapted to be placed to the right of FIG. 1A.

DESCRIPTION OF THE PREFERRED EMBODIMENT

Figure 1A:
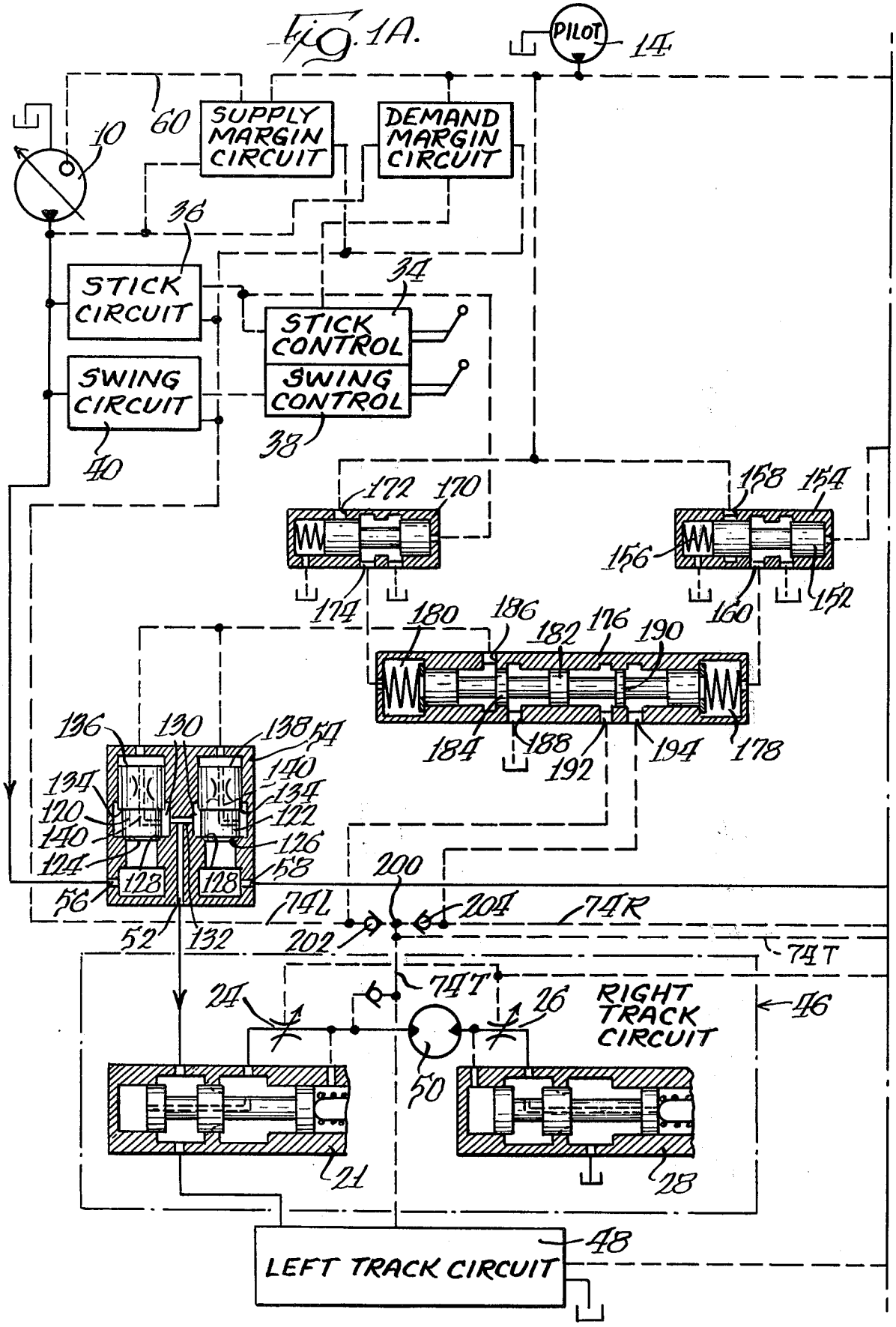
Figure 1B:
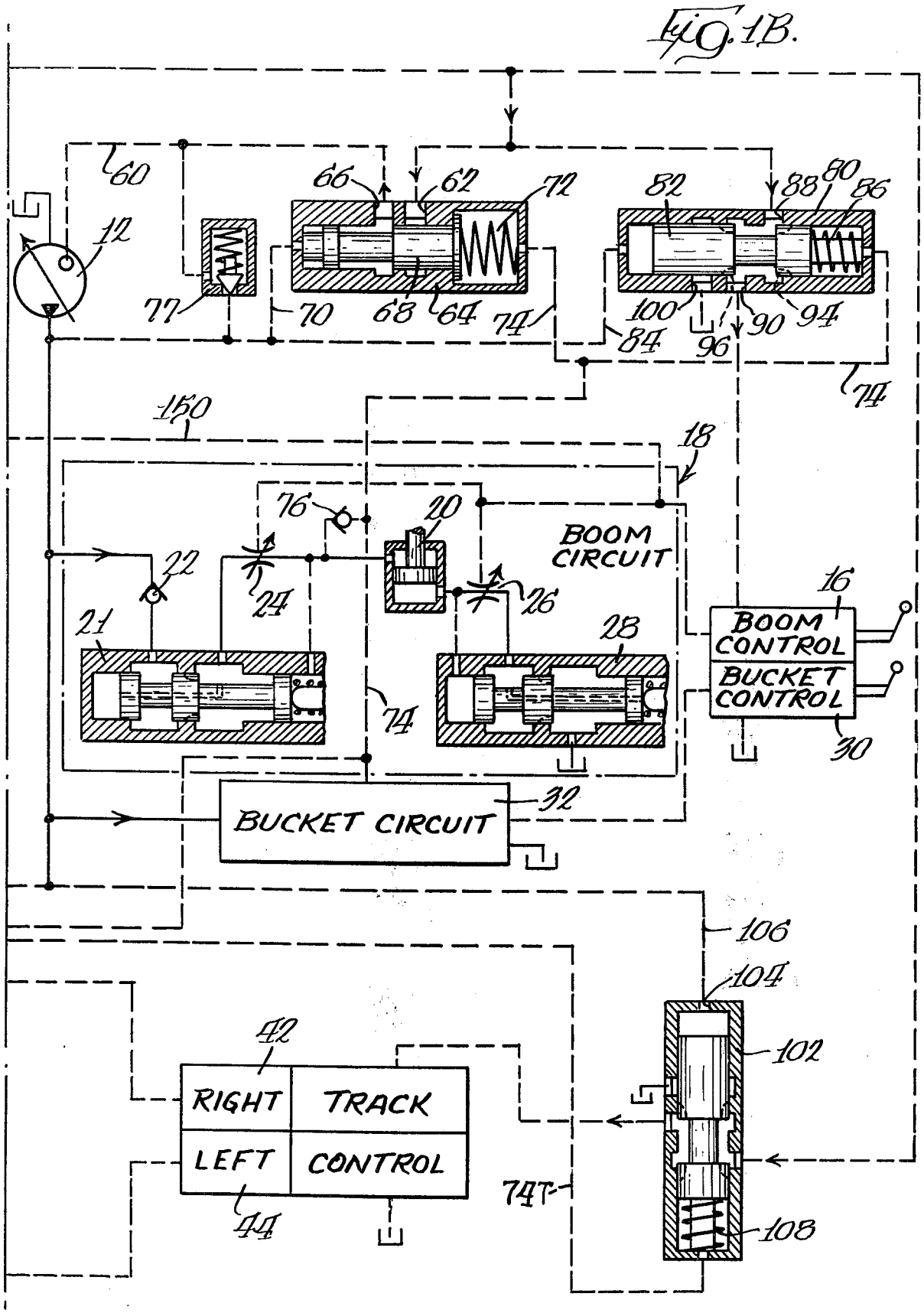

An exemplary embodiment of a hydraulic system made according to the invention is illustrated in FIGS. 1A and 1B in the form of a system for controlling the various work performing elements on a vehicle such as an excavator. Major system components include first and second flow and pressure compensated pumps 10 and 12 of conventional construction. As will be seen, the pumps 10 and 12 are of the type that will elevate the pressure of their output in response to a decrease in the pressure of a fluid signal applied thereto. However, it is to be understood that, if desired, the pumps 10 and 12 could be of the type that increase the pressure of their output in response to increasing pressure of a control signal.

The system includes a source of pilot fluid under pressure in the form of a pump 14. In addition, there are provided pilot operated main flow valves and associated operator positioned valves which control the pressure of pilot fluid to the main flow valve for each of the differing work performing means in the excavator.

For example, there is provided an operator positioned valve 16 which may be operated to apply pilot pressure to the main flow valving system, generally designated 18, which controls extension or retraction of a hydraulic cylinder 20 which operates the boom of the excavator. As illustrated in FIG. 1B, various conventional components of the main flow valving system 18 are eliminated for clarity. For example, the valves illustrated provide for only unidirectional operation of the cylinder 20 and are only partly shown. Other conventionally oriented valves are utilized to control operation of the cylinder 20 in the opposite direction.

The main flow valving system 18 includes a valve 21 which is connected via a check 22 to the output of the pump 12. A pilot operated metering valve 24 meters flow to the cylinder 20 when the valve 21 is opened while a pilot operated metering valve 26 controls outflow from the cylinder 20 to a further valve 28.

The system further includes an operator positioned valve 30 for controlling the pressure of pilot fluid to a bucket circuit 32 which will generally be of the same nature as the circuit 18. It will be observed that the bucket circuit 32 is connected, in parallel, to the output of the pump 12 with respect to the circuit 18.

Other like components are illustrated in FIG. 1A wherein there is illustrated an operator positioned valve 34 for controlling the pressure of pilot fluid to a stick circuit 36 for controlling the stick of the excavator. A similar operator positioned valve 38 controls the pressure of pilot fluid to a swing circuit 40 for controlling the position of the turret of the excavator on the vehicle frame.

As seen in FIG. 1B, right and left track control, operator positioned valves 42 and 44 control the pressure of pilot fluid to right and left track circuits 46 and 48. As with the circuit 18, the circuit 46 is only fragmentarily shown, omitting many conventional components for clarity.

Each of the circuits 18, 32 and 36 include work performing means in the form of hydraulic cylinders such as the cylinder 20. Each of the circuits 40, 46 and 48 include work performing means in the form of bidirectional hydraulic motors such as the motor 50 shown in the circuit 46.

As can be seen in FIG. 1A, the circuits 36 and 40 are connected in parallel to the output of the pump 10. The circuits 46 and 48 receive pressure fluid from a port 52 of a multi-component valve 54 which, in turn, has ports 56 and 58 connected respectively to the outputs of the pumps 10 and 12 and in parallel with respect to the other components connected to such pumps.

Each of the pumps 10 and 12 is provided with a control input on line 60. The manner in which the signal is provided is the same for both the pumps 10 and 12, so only the components providing the signal to the pump 12 will be described in detail.

Pilot fluid under pressure from the pump 14 is supplied to an inlet port 62 of a double-piloted, spring-assisted, metering valve 64. An outlet port 66 is connected to the line 60. The valve 64 includes a shiftable spool 68 provided with metering slots (not shown) for controlling the flow of fluid from the port 62 to the port 66, thereby providing a controlled but variable pressure signal to the pump 12 to adjust its action, as is well known. One end of the spool 68 is subject to pressure from the output of the pump 12 through a line 70, while the other end of the spool 68 is biased by a spring 72 as well as being subjected to fluid under pressure from a line 74. The pressure in the line 74 will be equal to the highest pressure demanded by any of the work performing means associated with the pump 12, as is well known. It is derived via check valves, such as check valve 76, connected between the work performing means, such as the cylinder 20, and the pilot controlled metering valve, such as the valve 24.

The arrangement is such that, within limits of its capacity, the pump 12 will always provide fluid at a pressure a substantially fixed margin, as, for example, 200 psi above the pressure demanded by the work performing means. When the predetermined margin is met, pressure in the line 74 and the spring bias provided by the spring 72 will balance the force applied by pressure in the line 70. Conversely, when the margin is exceeded, the spool 68 will shift to the right, increasing flow to the pump 12 to cause the same to decrease its output pressure. When the margin is not met, the spool 68 will shift to the left to decrease pilot flow to the pump 12, thereby causing the same to increase its output pressure.

The system also includes a shutoff valve 77 which, when a predetermined pressure at the output of the pump 12 is exceeded, will open to direct high pressure to the line 60 to cause the pump 12 to decrease its output pressure.

As mentioned, a similar circuit is provided for the pump 10 and the same is given the designation SUPPLY MARGIN CIRCUIT in FIG. 1A.

In many systems of the general type described, the capacity of the pumps 10 or 12 is not such as to be able to fully satisfy the demand of each of the associated work performing means, as generally alluded to previously. When maximum pump capacity is approached, and the pressure of the load signal on line 74 continues to increase, the valve 68 will shift to the left to signal the pump 12 to increase its capacity. However, because the pump's maximum capacity is met, or almost approached, very little, if any, increase in output pressure can be attained with the result that one or more of the work performing means will be partly or wholly starved of hydraulic fluid under pressure. To ensure that when such occurs, the more important one or ones of the work performing means are not starved, a DEMAND MARGIN CIRCUIT is provided for each of the pumps 10 and 12. The two are identical and, accordingly, only the demand margin circuit associated with the pump 12 will be described.

The same includes a spool valve 80 which is double-piloted and spring-assisted. One end of the spool 82 receives pump pressure through a line 84 while the other end receives load pressure from the line 74 and is also biased by a spring 86. The valve 80 includes an inlet port 88 connected to the pilot pump 14 and an outlet port 90 which is connected to some, but not all, of the operator positioned valves. As shown in FIG. 1B, the port 90 is connected only to the valves 16 and 30 and not to the valves 42 and 44.

In an excavator system, it is generally desirable that the fluid demands of the track circuit be satisfied before the fluid demands of the boom, bucket, stick and turret are met.

So long as the predetermined margin between supply pressure and load pressure is maintained through action of the valve 64, no problem exists. However, when that margin cannot be maintained, the demand margin circuit including the valve 80 reduces the flow demand of the selected work performing means, here, the boom and the bucket, to ensure that the demands of the track circuits are met.

As the load signal on the line 74 begins to increase, the spool 82 will begin to shift to the left, as viewed in FIG. 1B, with the consequence that metering slot 94 will begin to throttle the incoming flow of pilot fluid through the port 88 while other metering slots 96 will establish fluid communication with an outlet port 100 connected to tank. Consequently, pilot pressure to the operator positioned valves 16 and 30 will be decreased. As a consequence, pilot pressure provided by the valves 16 or 30 to the pilot operated metering valves, such as the valves 24 and 26 associated with the corresponding work performing means will be decreased, thereby reducing the flow of pressurized fluid to the associated work performing means from the pump 12. Thus, the demand margin circuits act as priority determining means to ensure that the needs of desired circuits, such as the track circuits, are met within pump capacity before the fluid needs of other, less important circuits are met to avoid starving of higher priority circuits.

If desired, the system may be provided with a priority sequencing feature through the inclusion of a valve 102 which may be identical, save in one respect, to the valve 80. The valve 102 receives a pump pressure signal at a port 104 via a line 106 and a load signal from the line 74T. The valve 102 is operative to control the supply of pilot fluid from the pilot pump 14 to the operator positioned valves 42 and 44 for the right and left track circuits.

The difference between the valve 102 and the valve 80 is the fact that the valve 102 has a biasing spring 108 which is lighter than the spring 86. Consequently, metering of the pilot fluid by the valve 102 will not occur until the difference between supply pressure and load pressure is considerably smaller than that required to initiate operation of the valve 80.

The invention also contemplates the provision of means whereby pressure fluid from either of the pumps 10 and 12 may be directed to any of the components. As will be appreciated from the foregoing description, the boom and bucket circuits normally are associated only with the pump 12 while the stick and swing circuits are normally only associated with the pump 10. As will be seen, the track circuits are associated with both.

In some instances, when only, for example, the boom and the bucket are being utilized, it may be desirable to utilize part of the capacity of the pump 10 for operating such components in addition to the capacity of the pump 12. Conversely, occasions may arise when only the swing and/or stick circuits are being utilized and it is desired to supplement the capacity of the pump 10 with the capacity of the pump 12.

The multi-component valve 54 provides for cross connection of the outputs of the pumps 10 and 12 so that either pump may be connected to a work performing means not normally associated therewith when such occasions arise. The valve 54 also directs the output of one or the other of the pumps 10 and 12, or both, to the track circuits, as previously mentioned.

The valve 54 is composed of two poppet valves having poppets 120 and 122, respectively. Each of the poppets 120 and 122 have a pressure responsive surface 124 and 126, respectively, in fluid communication with the ports 56 and 58, respectively. Valve seats 128 are provided for the poppets 120 and 122 to seat against. Downstream of the valve seats 128 from the ports 56 and 58, there are provided annular spaces 130 for each of the poppets 120 and 122 and the two annular spaces are connected to each other by a conduit 132 which, in turn, connects to the port 52.

Within each of the annular spaces 130, each poppet 122 includes an enlarged shoulder 134 which faces the same direction as the associated pressure responsive surface 124 and 126.

Each of the poppets 120 and 122 further includes an associated pressure responsive surface 136 and 138, respectively, which are in bucking relation to the surfaces 124 and 126. Finally, each poppet 120 and 122 is provided with a restricted fluid passage 140 which establishes fluid communication between the annular spaces 130 and the corresponding pressure responsive surfaces 136 and 138.

In the case where both the pumps 10 and 12 are providing substantially the same output pressure, flow therefrom will be directed against the pressure responsive surfaces 124 and 126 to cause both poppets 120 and 122 to move away from their seats 128. The flow from both pumps will enter the annular spaces 130 and be directed to the port 52 by the conduit 132 to provide fluid under pressure to the track circuits. Upon initial opening of the poppets 120 and 122, any fluid abutting the surfaces 136 and 138 tending to preclude poppet movement will be vented via the passages 140 to the annular spaces 130 and thus to the track circuits.

The flow of pressurized fluid through the valves will, at the same time, be directed against the shoulders 134 to maintain both poppets open.

In another situation, it may be assumed that the operator positioned valve 16 for the boom has been manipulated to increase demand for fluid for the boom to a level above that demanded by the work performing means normally associated with the pump 12. A line 150 connected to the output of the valve 16 directs pressure against one end of a spool 152 of a valve 154 to cause the same to move to the left, as viewed in FIG. 1A, against the bias of a spring 156. When this occurs, a flow path from an inlet 158 of the valve 154 is established to an outlet 160. The inlet 158 is connected to the pilot pump 14.

A similar valve 170 is connected to the output of the stick control valve 34 and when subject to pilot pressure from the valve 34, will open to establish a flow path between an inlet 172, also connected to the pilot pump 14, and an outlet 174.

The degree to which each of the valves 154 and 170 opens will be dependent upon the pilot pressure applied to each. A double-piloted spool valve 176 has one pilot 178 connected to the outlet 160 of the valve 154 and its other pilot 180 connected to the outlet 174 of the valve 170. The valve 176 is spring centered to the position shown and when neither pilot 178 or 180 are pressurized, or when both are receiving the same pressure, the spool 182 of the valve 176 will be in the position shown.

For the situation wherein the boom control valve 16 has been operated to cause a greater demand for the boom circuit than is called for by the stick circuit, the valve 154 will direct a greater pressure to the pilot 178 than will be directed to the pilot 180 by the valve 170. The spool 182 will, accordingly, move to the left with a first land 184 opening a flow path between an inlet 186 and an outlet 188. The outlet 188 is connected to drain while the inlet 186 is in fluid communication with the pressure responsive surfaces 136 and 138. Consequently, the valve 176 provides a bleed path for the poppets 120 and 122. At the same time, a land 190 on the spool 182 will establish a flow path between two ports 192 and 194.

The port 192 is connected to the load sensing line 74 associated with the stick and swing circuits, designated 74L in FIG. 1A, while the port 194 is connected to the load sensing line 74 associated with the boom and bucket circuits and this line is designated 74R in FIG. 1A only. The load sensing line for the track circuits, designated 74T, is connected to the junction 200 of two opposed checks 202 and 204 which are respectively connected to the line 74L and the line 74R. As can be seen, the checks 202 and 204, while openable to permit a high pressure signal from the junction 200 to be directed to the margin circuits for either or both of the pumps 10 and 12, preclude fluid communication between the lines 74L and 74R. However, when the land 190 of the valve 176 opens a flow path as mentioned previously, the check valves 202 and 204 are bypassed now establishing fluid communication between the lines 74L and 74R.

As a consequence, the increased demand for fluid by the boom caused by the previously mentioned actuation of the boom control valve 16 which will have resulted in an increased pressure in the line 74R will be fed to the supply margin circuit for the pump 10 causing the same to increase its output. Because the pressure responsive surfaces 136 and 138 have been simultaneously vented, notwithstanding the fact that a pressure differential may momentarily exist across the ports 56 and 58 of the valve 54, both poppets 120 and 122 will open to allow the now increased pressure and/or flow from the pump 10 to be directed to the boom by a flow path entering the port 56 and exiting the port 58. This will continue so long as the greater demand in the entire system is called for by the boom control 16.

The opposite action will occur should the stick control 34 be set such that the stick circuit 36 has greater demands than the boom.

It is to be observed that neither the bucket nor the swing control valves 30 and 38 can be operated to cause one of the pumps 10 or 12 to assist the bucket circuit or the swing circuit with which it is not normally associated. The purpose of this construction is unique to an excavator in that, typically, the bucket and swing circuits have large flow requirements with relatively low loading with the consequence that, in some situations, they could utilize almost the entire flow capacity of both pumps, thereby starving other system components. Consequently, when either the swing circuit or the bucket circuit are being operated, it is desired to isolate the pumps 10 and 12. In this situation, the bleed path through the valve 176 will be closed and because of the low loading of the bucket, for example, a relatively low pressure will be present at the port 58 with respect to the pressure present at the port 56. Assuming both poppets 120 and 122 to be open to allow the combining of the outputs of both pumps, when this pressure difference occurs, the poppet 120 will be maintained open and initially, fluid will flow from the high pressure side to the low pressure side, namely, from the port 56 through the conduit 132 to the port 58. A pressure drop will occur during such flow in the conduit 132 with the consequence that a relatively higher pressure will be applied to the pressure responsive surface 138 due to its fluid communication with the left-hand annular space 130 via the flow passage 140 in the poppet 120. As a result, the poppet 122 will close thereby halting the combining of the output of both the pumps.

Should the swing circuit be calling for a high flow rate, the reverse of the foregoing action will occur with the poppet 120 closing to halt the combining of the outputs of the two pumps.

In either event, pressurized fluid will continue to be directed to the track circuit through whichever one of the poppet valves 120 and 122 that remains open.

From the foregoing, it will be appreciated that a hydraulic system made according to the invention assures priority of application of fluid under pressure to those system components having the more important functions when pump capacity is approached or exceeded by load demand. It will also be appreciated that the invention provides a means of sequencing priorities if desired. Finally, it will be appreciated that the invention provides a unique means whereby the discharge of plural pumps may be selectively combined or isolated as system components require.

The embodiments of the invention in which an exclusive property or privilege is claimed are defined as follows:

1. In a hydraulic system, the combination of:

a pressure and flow compensated pump;

a source of pilot fluid under pressure;

a plurality of hydraulic circuits, each including a work performing means;

a plurality of controls, one for each circuit, each including a pilot operated flow valve for connecting the associated work performing means to said pump and an operator positioned valve connected to said source for selectively directing pilot fluid to the corresponding flow valve;

each work performing means and the corresponding flow valve being connected in parallel with respect to the other flow valves and work performing means;

means connected to said work performing means and said pump for controlling said pump to supply fluid at a pressure in excess by a predetermined margin of that required by any of said work performing means; and priority determining means connected to said source and to at least one, but not all, of said operator positioned valves for changing a pressure characteristic of the pilot flow to the operator positioned valve(s) to which it is connected whenever the pressure of the supply fluid from said pump does not exceed the pressure required by any of said work performing means by said predetermined margin to cause the flow valve(s) associated with said operator positioned valve(s) to which it is connected to decrease flow to the associated work performing means;

whereby priority of supply fluid flow to the work performing means not associated with said priority determining means is assured.

2. The hydraulic system of claim 1 further including additional means for changing a pressure characteristic of the pilot flow to at least one of the operator positioned valves not connected to said priority determining means whenever the pressure of said supply fluid does not exceed the pressure required by said work performing means by an amount considerably less than said predetermined margin.

3. The hydraulic system of claim 1 wherein said priority determining means comprises a double piloted, metering valve having an inlet, an outlet, and one of the pilots being spring assisted, said inlet being connected to said source and said outlet being connected to said at least one operator positioned valve, the spring assisted pilot being connected to each or said work performing means, and the other pilot being connected to said pump.

4. A pair of hydraulic systems, each according to claim 1 and further including means for selectively connecting the systems such that (a) the pump of either system is connected in circuit with at least one of the flow valves of the other system, (b) said controlling means of each system is responsive to the highest supply fluid pressure in either system and to the highest pressure required by the work performing means in either system, and (c) said priority determining means is responsive to supply fluid pressure less than said predetermined margin above said work performing means highest pressure.

5. The pair of hydraulic systems of claim 4 wherein said selective connecting means comprises a pair of pilot operated valves, each having a first port connected to the associated pump, and second ports connected to each other, the pilots of each poppet valve being connected by orifices to each other and to said second ports and to a selectively operable bleed valve.

6. A hydraulic system comprising:

a plurality of pressure and flow compensated pumps;

a plurality of controllable work performing means, each normally connectable by control valves to a particular one of said pumps; and means for connecting each of said work performing means to at least one of said pumps in addition to or other than said particular pump including a plurality of pilot operated poppet valves each having a first port connected to an associated one of said pumps and interconnected second ports, bleed valve means responsive to pressure differentials between said pumps, and orifice means interconnecting the pilots of said poppet valves, said second ports and said bleed valve means.

7. The hydraulic system of claim 6 wherein said orifice means comprise a plurality of orifices, one for each poppet valve, interconnecting the pilot and the second port of the associated poppet valve, and a conduit connecting all of said pilots to said bleed valve means.

8. In a hydraulic system, the combination of:

a pressure and flow compensated pump;

a source of pilot fluid under pressure;

a plurality of hydraulic circuits, each including a work performing means;

a plurality of controls, one for each circuit, each including a pilot operated flow valve for connecting the associated work performing means to said pump and an operator positioned valve connected to said source for selectively directing pilot fluid to the corresponding flow valve;

each work performing means and the corresponding flow valve being connected in parallel with respect to the other flow valves and work performing means;

a supply margin valve having pressure responsive surfaces respectively connected to said pump and to said work performing means for providing a control signal to said pump to cause the same to supply fluid at a pressure equal to pressure required by said work performing means plus a predetermined margin; and a demand margin valve having pressure responsive surfaces respectively connected to said pump and to said work performing means for decreasing the pressure of pilot fluid directed to some, but not all, of said operator positioned valves when said predetermined margin is not met.

9. In a hydraulic system, the combination of:

a pressure and flow compensated pump;

a source of pilot fluid under pressure;

a plurality of hydraulic circuits, each including a work performing means;

a plurality of controls, one for each circuit, each including a pilot operated flow valve for connecting the associated work performing means to said pump and an operator positioned valve connected to said source for selectively directing pilot fluid to the corresponding flow valve;

each work performing means and the corresponding flow valve being connected in parallel with respect to the other flow valves and work performing means;

a supply margin valve having pressure responsive surfaces respectively connected to said pump and to said work performing means for providing a control signal to said pump to cause the same to supply fluid at a pressure equal to pressure required by said work performing means plus a predetermined margin;

a first demand margin valve having pressure responsive surfaces respectively connected to said pump and to said work performing means for decreasing the pressure of pilot fluid directed to some, but not all, of said operator positioned valves when said predetermined margin is not met; and a second demand margin valve having pressure responsive surfaces respectively connected to said pump and to said work performing means for decreasing the pressure of pilot fluid directed to at least one of the others of said operator positioned valves when said predetermined margin is not met by more than a predetermined amount so that said first demand margin valve will decrease pilot pressure to said some valves before said second demand margin valve will decrease pilot pressure to said other valves.

* * * * *